US007252456B1

(12) United States Patent
Face, III

(10) Patent No.: US 7,252,456 B1
(45) Date of Patent: Aug. 7, 2007

(54) PORTABLE FORM AND METHOD FOR USING SAME FOR CONCRETE STRIKE-OFF

(75) Inventor: S. Allen Face, III, Wilmington, NC (US)

(73) Assignee: Laser Strike, LLC, Wilmington, NC (US)

( * ) Notice: Subject to any disclaimer, the term of this patent is extended or adjusted under 35 U.S.C. 154(b) by 0 days.

(21) Appl. No.: 11/335,227

(22) Filed: Jan. 19, 2006

(51) Int. Cl.
*E01C 19/22* (2006.01)

(52) U.S. Cl. ..... 404/118; 404/112

(58) Field of Classification Search ..... 404/118, 404/106, 112
See application file for complete search history.

(56) References Cited

U.S. PATENT DOCUMENTS 2,155,571 A * 4/1939 Tullis ..... 15/235.8
2,306,671 A * 12/1942 Tamblyn ..... 52/678
4,298,555 A * 11/1981 Weltmer ..... 264/31
4,371,330 A * 2/1983 Heffernan ..... 425/458
4,795,332 A * 1/1989 Davis ..... 425/60
4,861,188 A * 8/1989 Rouillard ..... 404/75
4,913,582 A * 4/1990 Barrett ..... 404/119
5,212,919 A * 5/1993 Shaw et al. ..... 52/126.6
5,257,764 A * 11/1993 Spaulding ..... 248/125.1
5,533,831 A * 7/1996 Allen ..... 404/114
6,709,194 B1 * 3/2004 Grimes ..... 404/96
6,866,445 B2 * 3/2005 Semler ..... 404/119

* cited by examiner

*Primary Examiner*—Raymond Addie
(74) *Attorney, Agent, or Firm*—Peter J. Van Bergen

(57) ABSTRACT

A form for concrete strike-off includes a pan adapted to float on a plastic concrete surface, a rigid straightedge, and a support. The straightedge is coupled on one end to the pan and the support is coupled to the opposing end of the straightedge with the straightedge thereby defining a reference elevation for concrete strike-off operations.

28 Claims, 6 Drawing Sheets

PORTABLE FORM AND METHOD FOR USING SAME FOR CONCRETE STRIKE-OFF

FIELD OF THE INVENTION

The invention relates generally to concrete strike-off tools and methods, and more particularly to a portable apparatus that can be used to define a form for concrete strike-off operations.

BACKGROUND OF THE INVENTION

In concrete slab construction, the manual striking off of wet or plastic concrete is a labor intensive process that generally consists of three steps, the first of which will differ according to the desired elevation of the finished concrete surface. For example, if the finished surface is intended to parallel the base over which the concrete is being placed (thereby resulting in a slab of constant thickness), then the wet concrete surface at various small isolated spots is first struck off to its intended finished elevation by measuring up from the base using a gage stick equal in length to the desired finished slab thickness. If, however, the finished surface is not necessarily intended to be of constant thickness, but is instead intended merely to be planar, then the wet concrete surface at various small isolated spots is first struck off to its intended finished elevation by using an optical or laser level and grade stick to define the desired plane. In both of these above-described cases, the small isolated reference spots that are initially formed in the wet concrete surface are termed "wet pads". To facilitate subsequent strike-off operations, the distances between adjacent wet pads are kept somewhat shorter than the length of the straightedge that is to be used to strike off the bulk of the concrete.

The second step in a manual strike-off operation involves using the straightedge and two adjacent wet pads as elevation references. The concrete between the wet pads is struck off to create a narrow, elongated section of at-grade concrete that is termed a "wet screed". Again, to facilitate subsequent strike-off operations, the wet screeds are generally made to parallel one another at spacings somewhat shorter than the length of the straightedge.

The last step in a manual strike-off operation involves using the straightedge and two adjacent wet screeds as elevation references to strike off the concrete between the wet screeds to grade. However, owing to the plastic, unstable character of the wet pads and wet screeds that are used to control the elevation of the straightedge, the finished surfaces produced by this so-called "wet screed" method of concrete slab construction typically exhibit poor conformity to the desired grade.

SUMMARY OF THE INVENTION

Accordingly, it is an object of the present invention to provide an apparatus that simplifies the positioning and establishment of a temporary and rigid reference form to control the elevation of a straightedge as it is used to strike-off a concrete slab either to a constant thickness or a plane.

Other objects and advantages of the present invention will become more obvious hereinafter in the specification and drawings.

In accordance with the present invention, a form for concrete strike-off is provided. A pan adapted to float on a plastic concrete surface has a rigid straightedge coupled thereto. More specifically, the straightedge has first and second ends opposing one another along a longitudinal dimension thereof. The first end is adjustably coupled to the pan such that the first end can at least be rotated relative to the pan. A support is coupled to the second end of the straightedge with the straightedge thereby defining a reference elevation for concrete strike-off operations. Each such apparatus can be used by itself or in concert with a multiplicity thereof to set temporary forms for a concrete strike-off operation. Each apparatus operates independently to set a form at, or parallel to, the locally desired grade of the finished concrete.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
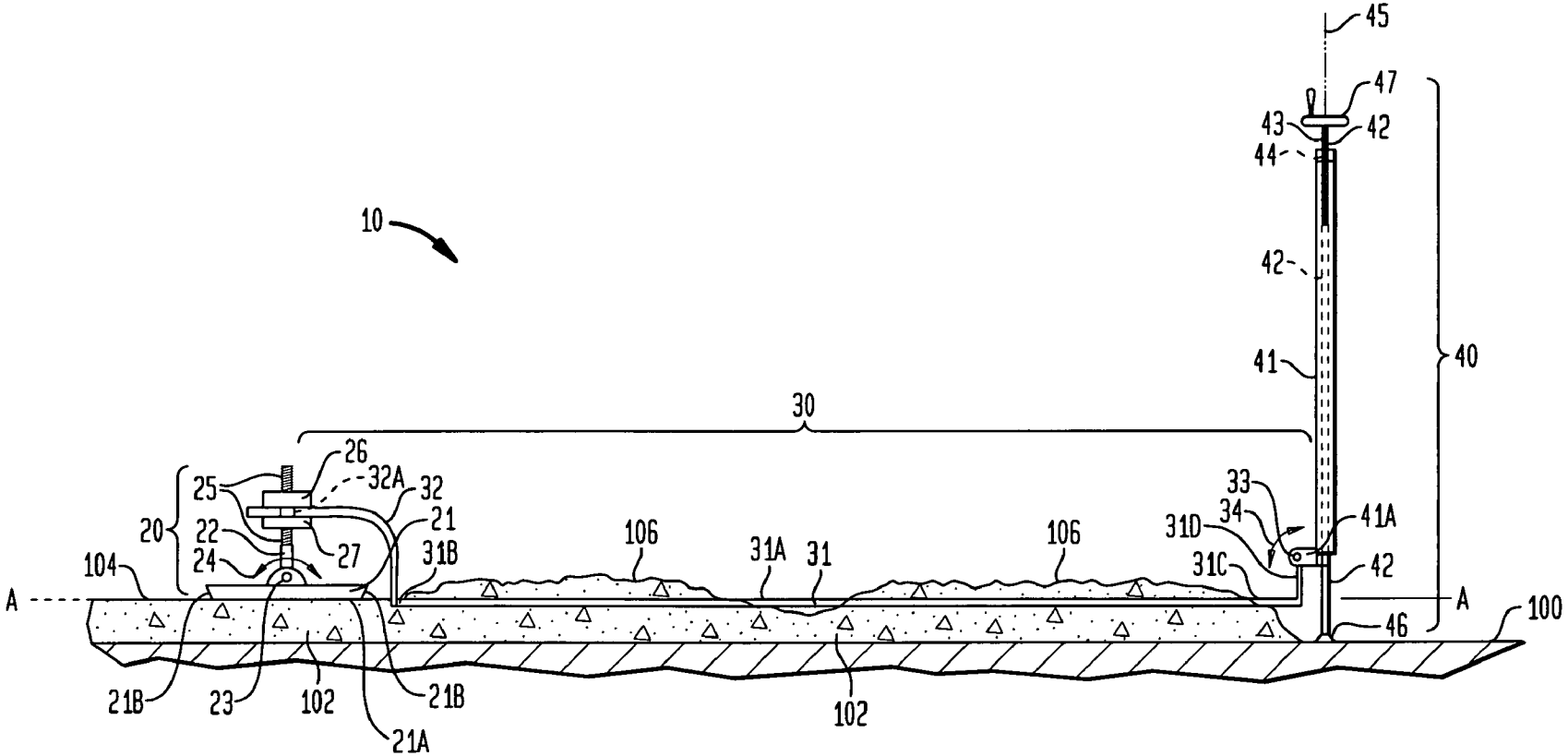
FIG. 1 is a side view of an apparatus that can be used to define a form used in a concrete strike-off operation in accordance with an embodiment of the present invention.

Referring now to the drawings, and more particularly to FIG. 1, an apparatus for defining a form in a concrete strike-off operation is shown and is referenced generally by numeral 10. Apparatus 10 is illustrated in an operational set-up in which an underlying base structure is referenced by numeral 100, wet or plastic concrete is referenced by numeral 102, a finished surface of the plastic concrete at desired grade A-A is referenced by numeral 104, and an unfinished surface of the plastic concrete is referenced by numeral 106.

Apparatus 10 includes three main assemblies that are coupled to one another. The assemblies are a pan assembly 20, a form assembly 30, and a support assembly 40. In general, pan assembly 20 floats on finished surface 104 while providing the means to set the elevation of one end of form assembly 30. Support assembly 40 rests on underlying base structure 100 while providing the means to set the elevation of another end of form assembly 30 by, for example, being extensible and retractable in length as in the illustrated embodiment. Form assembly 30 defines a finished surface reference form for the concrete being struck-off. After reading the ensuing description of the illustrated embodiment and the use thereof, one of ordinary skill in the art will readily appreciate that the functions of each of pan assembly 20, form assembly 30, and support assembly 40 could be realized by a variety of constructions without departing from the scope of the present invention. Accordingly, it is to be understood that the illustrated embodiment is presented as a non-limiting example of the present invention.

In the illustrated embodiment, pan assembly 20 includes a pan 21 having a flat bottom 21A that is large enough so that pan assembly 20 can float on finished surface 104. For reasons that will become clearer below, some or all of the edges of pan 21 can be beveled as indicated by numeral 21B to facilitate the movement of pan 21 on finished surface 104. Attached to pan 21 is post 22. More specifically, in the illustrated embodiment, post 22 is connected to pan 21 via a pivot or hinge 23 so that post 22 is freely rotatable thereabout (as indicated by two-headed arrow 24) in a plane that is substantially perpendicular to pan 21. Post 22 is threaded along some or all of the length thereof (as indicated at 25) to threadably engage top and bottom nuts 26 and 27, respectively.

Form assembly 30 includes a long rigid bar 31 having a top 31A defining a finished surface reference form for concrete strike-off. Thus, as will typically be the case, top 31A defines a straight edge. However, the present invention is not so limited. That is, without departing from the scope of the present invention, rigid bar 31 can be configured in a variety of ways (e.g., a variety of different cross-sectional shapes) such that some element thereof other than it's top serves as the finished surface reference form.

One longitudinal end 31B of bar 31 is coupled to pan assembly 20 while the other longitudinal end 31C of bar 31 is coupled to support assembly 40. In the illustrated embodiment, bar 31 is coupled to pan assembly 20 by a rigid L-shaped or "gooseneck" bracket 32 rigidly and/or fixedly coupled to end 31B. A hole 32A formed in an outboard end of bracket 32 is sized to slip over post 22 as shown with nuts 26 and 27 being used to capture bracket 32 therebetween as will be explained further below.

End 31C of bar 31 is coupled to support assembly 40 in any of a variety of ways that provide for vertical movement (relative to desired grade A-A) of end 31C as support assembly 40 extends/retracts. For example, a vertical extension member 31D can be provided on bar 31 with member 31D being coupled to support assembly 40 at a coupling point 33. The use of vertical extension member 31D keeps the vertically movable portion of support assembly 40 out of the wet concrete 102.

In the illustrated embodiment, support assembly 40 includes an open-ended outer sleeve 41 and a rod 42 that passes through the central portion of sleeve 41 and extends from either end thereof. Rod 42 is threaded at least partially therealong at 43 for threaded cooperation with mating threads 44 in sleeve 41. As a result, sleeve 41 and rod 42 share a common longitudinal axis referenced by dashed line 45. When rod 42 is rotated about longitudinal axis 45 while sleeve 41 is maintained in a non-rotating relationship, sleeve 41 moves towards one end or the other of rod 42 thereby causing the lengthening or shortening of support assembly 40.

Sleeve 41 is coupled to bar 31 via vertical extension member 31D. For example, sleeve 41 can incorporate an extension bracket 41A that connects to member 31D at coupling point 33. Although not a requirement of the present invention, coupling point 33 could be realized by a hinge or pivot that provides for free rotation thereabout as indicated by two headed arrow 34. The plane of rotation 34 can be aligned with that of the plane of rotation 24.

One end of rod 42 will be positioned on underlying base structure 100. Accordingly, this end can have a swiveling foot or pad 46 coupled thereto to engage support 100 in a non-slip fashion. The opposing longitudinal end of rod 42 can have a hand crank 47 coupled thereto to facilitate the manual turning of rod 42 about longitudinal axis 45.

As will be explained further below, use of apparatus 10 involves an initial set-up with both ends 31B and 31C being set at a desired elevation, and subsequent checks of the elevation of end 31C each time apparatus 10 is moved. The elevation setting/checking of end 31C can be accomplished with a variety of instruments well known in the art. For example, as illustrated in FIG. 2A, support assembly 40 can include a laser receiver 48 mounted to a bracket 49 that, in turn, is coupled to sleeve 41. Bracket 49 should provide for the adjustable positioning of laser receiver 48 in either direction 50 that is parallel to longitudinal axis 45. As is well understood in the art, laser receiver 48 is designed to receive a laser beam (not shown) projected in a plane in order to indicate when laser receiver 48 is "on grade" with respect to the laser beam. Before use, the position of laser receiver 48 is adjusted on bracket 49 to make the vertical distance between laser receiver 48 and top 31A at end 31C equal to the vertical distance between the laser beam (not shown) and desired grade A-A. By virtue of this set up, whenever laser receiver 48 indicates "on grade", top 31A at end 31C will coincide with desired grade A-A.

Figure 2B:
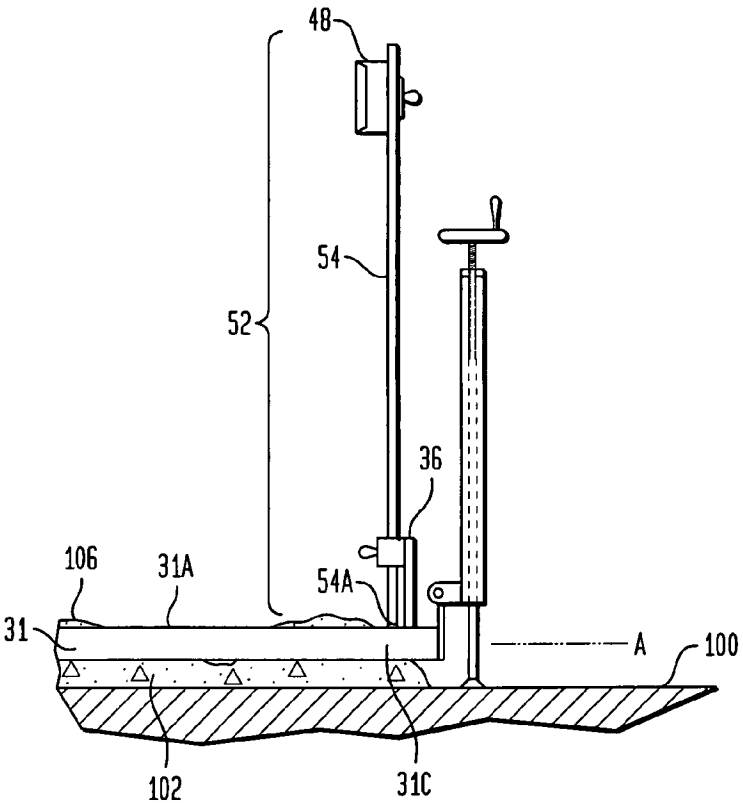
FIG. 2B is a side view of one end of the present invention's form assembly further having a holder coupled thereto for supporting a removable pole and laser receiver assembly.
Figure 2A:
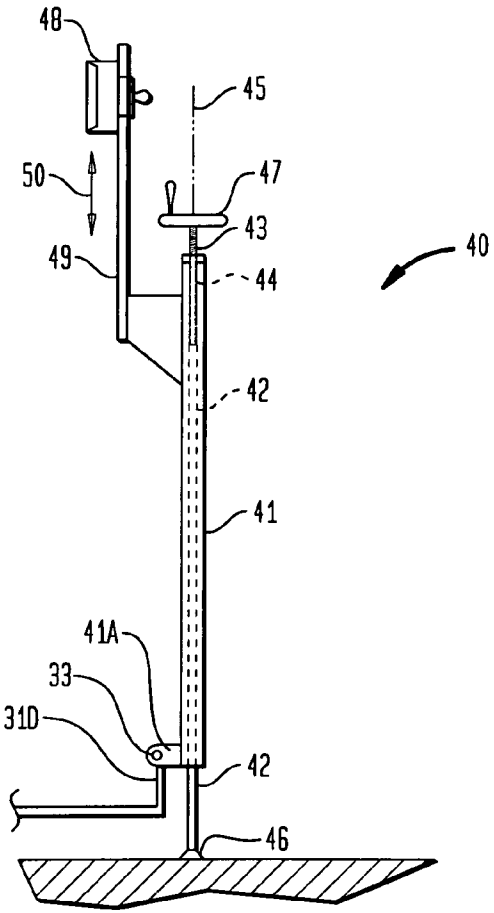
FIG. 2A is a side view of the present invention's support assembly illustrated in FIG. 1 further having a laser receiver coupled thereto.

Another option is illustrated in FIG. 2B where a holder 36 can be mounted on bar 31 at end 31C to provide upright support for a removable pole and laser receiver assembly 52 resting directly on top 31A. More specifically and as would be well understood in the art, laser receiver 48 is positioned before use on a pole 54 to make the vertical distance between laser receiver 48 and the bottom 54A of pole 54 equal to the vertical distance between the laser beam (not shown) and desired grade A-A. Accordingly, whenever laser receiver 48 indicates "on grade" and bottom 54A of pole 54 is in contact with top 31A at end 31C, top 31A at end 31C will coincide with desired grade A-A.

Apparatus 10 can be used by itself or in groups of two or more to set a temporary form for concrete strike-off. Use of apparatus 10 begins by first finishing a wet pad of plastic concrete to the desired grade/elevation (e.g., a finished patch at grade A-A referenced in FIG. 1). This initial wet pad should be large enough to support pan 21. With pan 21 on the initial wet pad, nuts 26 and 27 are loosened about bracket 32. Post 22 is positioned to be substantially perpendicular to pan 21 so that movement of bracket 32 up or down on post 22 translates into corresponding up or down elevation changes for bar end 31B. Laser receiver 48 (mounted on support assembly 40 or as part of assembly 52), or any of a variety of other well-known elevation measurement systems (not shown), is used to gage the elevation of top 31A at end 31C relative to desired grade A-A. Then, with pad 46 resting on underlying base structure 100, hand crank 47 is turned until top 31A at end 31C coincides with the desired grade A-A. Next, a conventional elevation measurement system (e.g., pole and laser receiver assembly 52) is used at end 31B while bottom nut 27 is rotated up or down on post 22 until top 31A at end 31B is also at the desired grade A-A. Once this is achieved, nuts 26 and 27 are rotated to abut and tighten against bracket 32 thereby fixing bracket 32 and end 31B to post 22. By virtue of this initial set-up routine, whenever pan 21 is supported on concrete that has been struck-off to the desired grade A-A, top 31A at end 31B will coincide with the desired grade A-A.

As mentioned above, one or more of apparatus 10 can be used in a concrete strike-off operation. Accordingly, FIG. 3 will be used to describe a strike-off operation using one of apparatus 10 and FIG. 4 will be used to describe a strike-off operation using two of apparatus 10.

Figure 3:
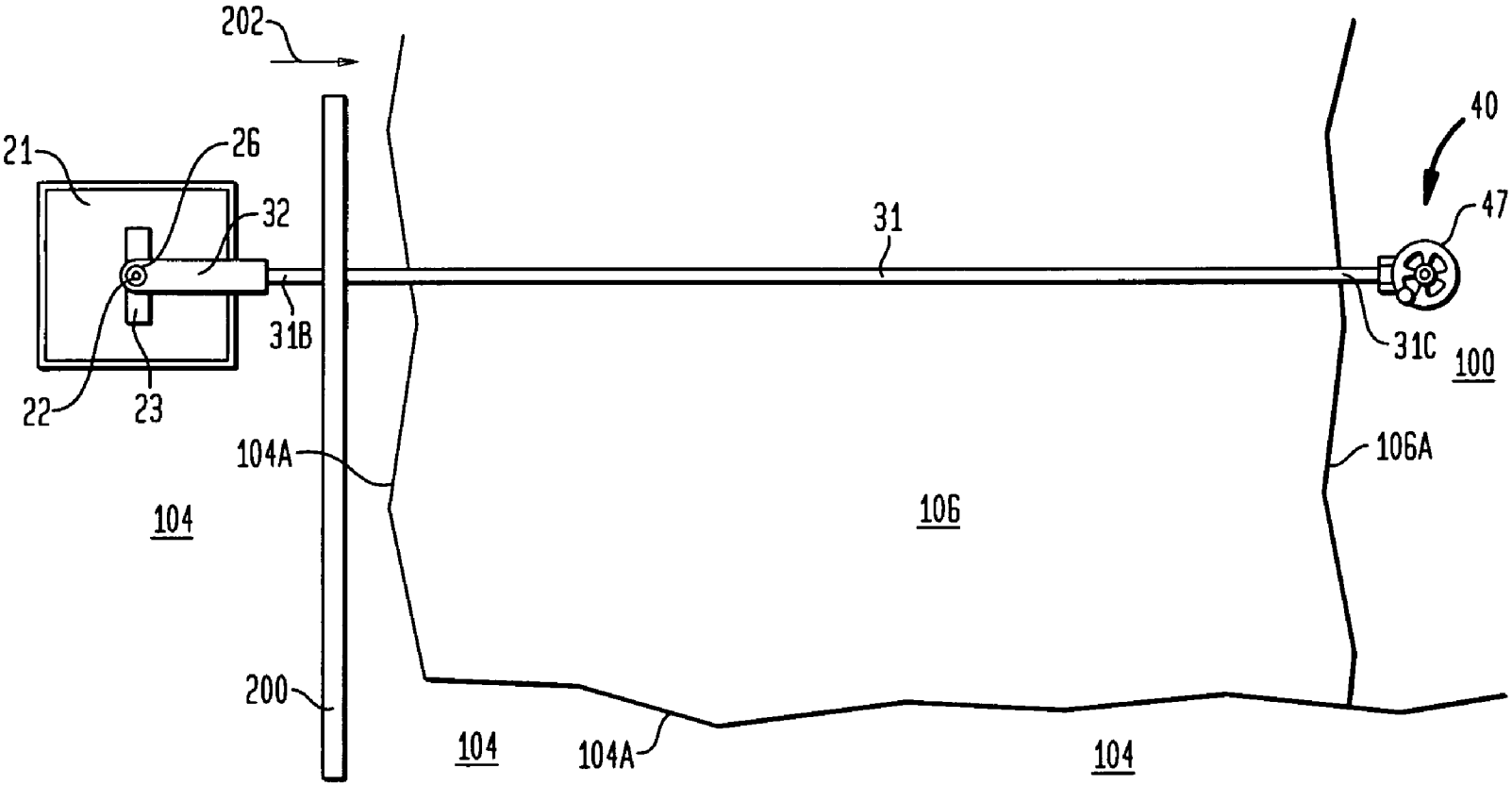
FIG. 3 is a plan view of an operational set-up utilizing one form apparatus.

In FIG. 3, it will be assumed that a region of finished concrete surface 104 at a desired elevation (achieved during previous strike-off cycles) extends up to finished boundaries 104A. Unfinished plastic concrete surface 106 extends between boundaries 104A up to boundary 106A at which point underlying base structure 100 is visible. The operator (not shown) manipulates apparatus 10 using support assembly 40 as a handle. Specifically, as support assembly 40 is raised, bar 31 pivots about pivot 23. Note that such manipulation is made even easier if coupling point 33 (FIGS. 1 and 2) is also a pivot point. When support assembly 40 and bar 31 are lifted free of the wet concrete, pan 21 can be moved/skied on finished concrete surface 104 to a new position such as the one shown in FIG. 3. The operator then places support assembly 40 with pad 46 resting on underlying base structure 100 such that its longitudinal axis 45 is substantially perpendicular thereto as best seen in FIG. 1. In doing this, bar 31 will be partially or completely submerged in the unfinished concrete. Next, using a conventional elevation measurement system (e.g. laser receiver 48 in either mounting configuration described above), hand crank 47 is rotated until top 31A at end 31C coincides with the desired grade A-A. Since pan 21 is resting on finished surface 104, top 31A at end 31B is already at the desired grade A-A from the initial set-up or previous strike-off cycle. To strike-off unfinished concrete surface 106, the operator simply places a strike-off straightedge 200 such that it is supported on one end by finished surface 104 and on the other end by top 31A of bar 31. Moving straightedge 200 in direction 202 causes unfinished surface 106 to be struck-off to the same elevation as finished surface 104. This cycle can then be repeated for the next unfinished region.

Figure 4:
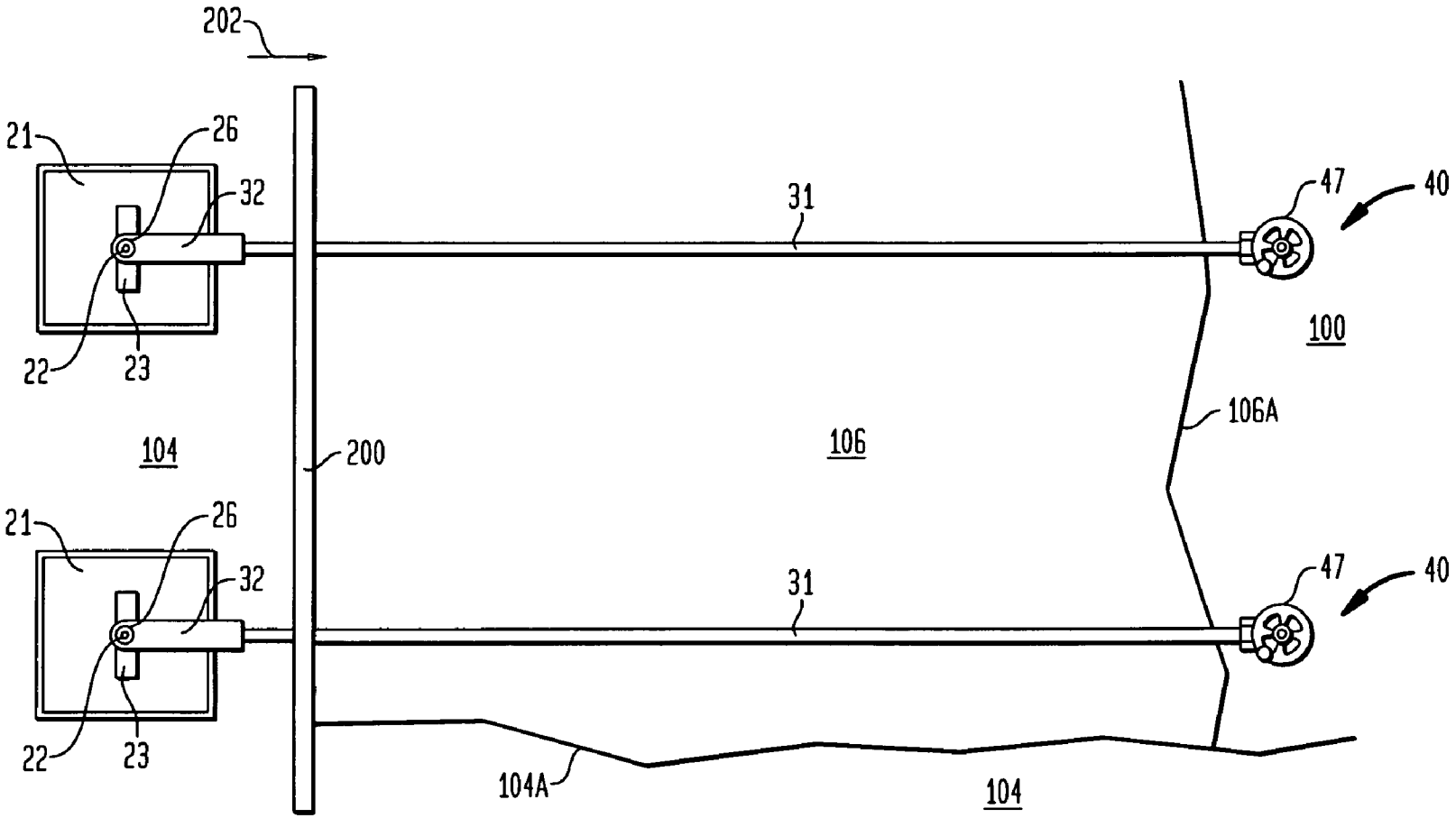
FIG. 4 is a plan view of an operational set-up utilizing two of the form apparatuses.

A similar process is used when two or more of apparatus 10 are used. For example, FIG. 4 show two of apparatus 10 being used with pans 21 supported on finished surface 104 and support assemblies 40 being supported on underlying base structure 100. The two bars 31 are separated by a distance that will support strike-off straightedge 200. Each apparatus 10 is operated independently with their respective bars 31 being positioned at the same locally desired grade A-A. Thus, it can easily be appreciated how a multiplicity of apparatus 10 can be used in concert to provide for the accurate strike-off of large areas of unfinished concrete surfaces.

Figure 5:
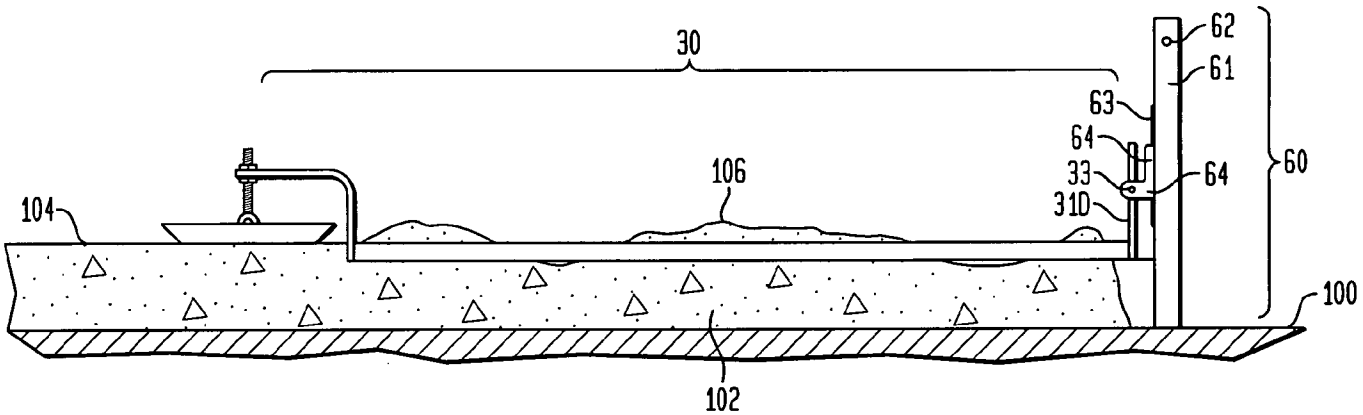
FIG. 5 is a side view of an apparatus that can be used to define a form used in a concrete strike-off operation in accordance with another embodiment of the present invention.

As mentioned above, the present invention is not limited to the particular embodiment just described. For example, the form of the present invention could be achieved in a variety of ways without departing from the scope of the present invention. One such approach is illustrated in FIG. 5 where a fixed-length support assembly 60 is shown coupled to a form assembly 30. Assembly 60 is representative of any fixed-length support that can be coupled to form assembly 30. The particular design of the support is not a limitation of the present invention. By way of illustrative example, assembly 60 includes a rigid post or pole 61 with a handle 62 typically being provided at the top thereof. Mounted on or integrated with pole 61 is a vertical rail 63 (e.g., a dovetail). A bracket 64 is slidingly mounted to rail 63. A locking screw 65 threaded through bracket 64 bears against rail 63 to set a vertical height of bracket 64 on pole 61. Vertical extension member 31D is coupled to bracket 64 at (pivot) point 33 in the same fashion as previously described.

Figure 6:
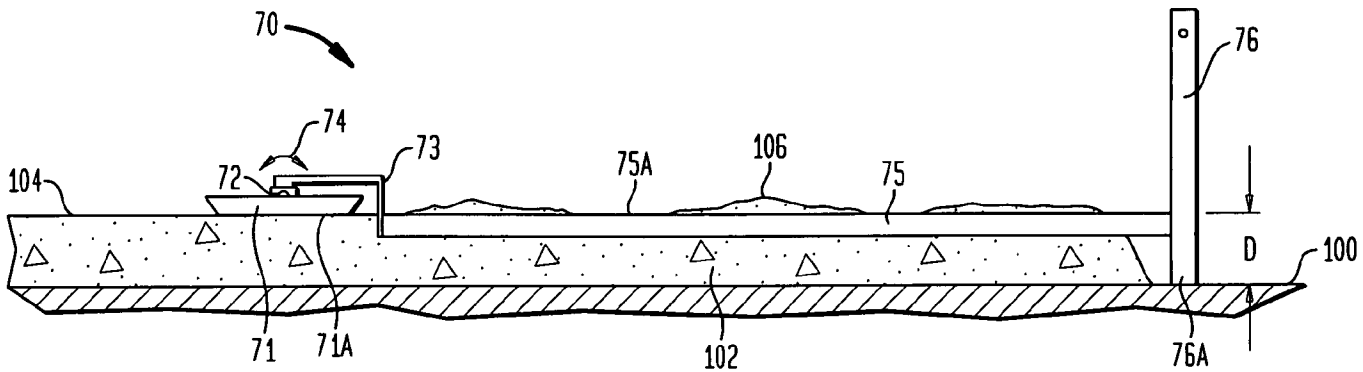
FIG. 6 is a side view of an apparatus that can be used to define a form used in a constant-thickness concrete strike-off operation in accordance with another embodiment of the present invention.

The present invention can be further adapted/simplified for cases where a finished concrete surface will be of constant thickness in all uses thereof. For example, FIG. 6 illustrates an apparatus 70 in accordance with another embodiment of the present invention that includes:

a floating pan 71, an L-shaped or "goose-neck" bracket 73 coupled to pan 71 at a position 72 where position 72 is representative of either (i) a fixed coupling between pan 71 and bracket 73 such that relative movement therebetween is prevented, or (ii) a coupling that provides for relative movement between pan 71 and bracket 73, e.g., a hinge that permits rotation of bracket 73 about position 72 in a plane as indicated by two-headed arrow 74, a swivel that permits rotation of bracket 73 about position 72 in a multiplicity of planes, etc., a rigid bar 75 fixedly coupled on one end thereof to bracket 73 with the top 75A of bar 75 being aligned with the bottom 71A of pan 71, and a rigid support such as a post or pole 76 to which bar 75 is fixedly coupled on the other end thereof such that the distance D between top 75A and the bottom 76A of pole 76 is equal to the desired concrete thickness.

In this configuration, apparatus 70 can be used to strike-off wet concrete to a constant thickness D once an initial wet pad of concrete at thickness D has been established for the initial placement of pan 71.

Figure 7:
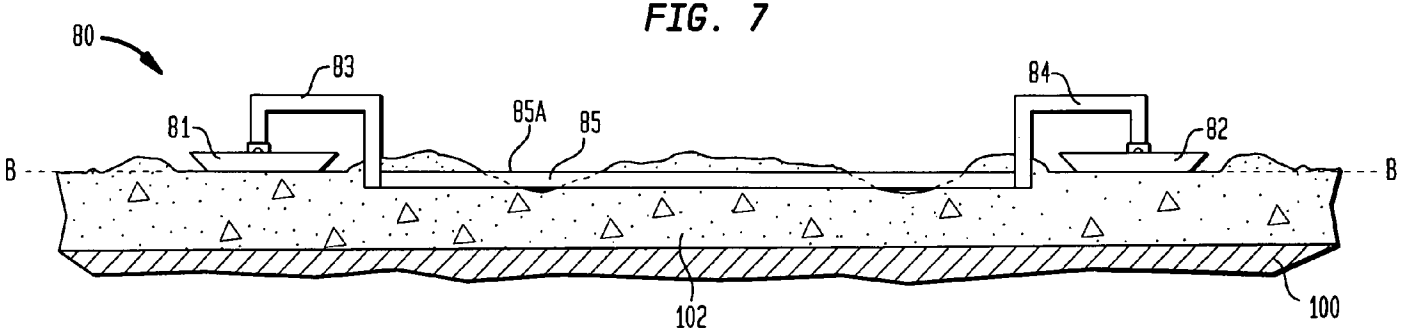
FIG. 7 is a side view of another embodiment of the present invention that can be used to define a form used in a concrete strike-off operation.

Still another embodiment of the present invention is illustrated in FIG. 7 where a form apparatus 80 includes:

two pans 81 and 82, each of which is capable of floating on wet concrete, gooseneck brackets 83 and 84 coupled to pans 81 and 82, respectively, and a rigid bar 85 fixedly coupled on one end thereof to bracket 83 and on the other end thereof to bracket 84 with the top 85A of bar 85 being aligned with the bottoms of pans 81 and 82.

Thus, in this embodiment, pans 81 and 82 define completely floating supports for bar 85.

Similar to the FIG. 6 embodiment, form apparatus 80 can be used to strike-off wet concrete to a desired grade B-B once wet pads of concrete at grade B-B have been established underpans 81 and 82. However, as would be readily understood by one of ordinary skill in the art, form apparatus 80 could be adapted to correct for errors in the establishment of the wet pads supporting pans 81 and 82 simply by providing an adjustable height coupling between either or both of the gooseneck bracket/pan combinations such as the one described above for pan assembly 20 in FIG. 1.

Figure 8:
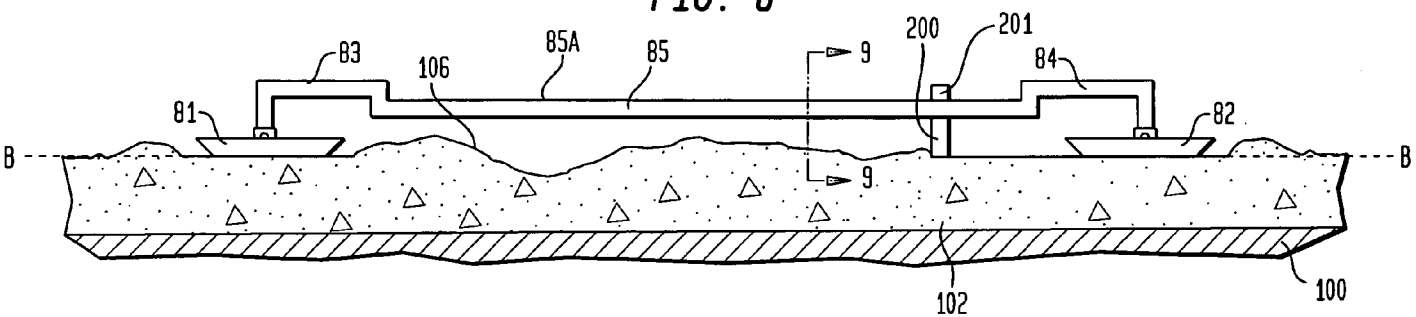
FIG. 8 is a side view of another embodiment of the present invention in which the form apparatus's rigid bar is suspended above the unfinished wet concrete.
Figure 9:
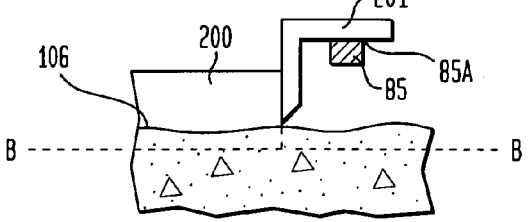
FIG. 9 is a view taken along line 9-9 in FIG. 8.

In each of the above-described embodiments, the apparatus's rigid bar defines a reference elevation that is the actual concrete strike-off elevation. However, the present invention is not so limited as the rigid bar could be suspended over the wet concrete with the bar defining a reference elevation that is parallel to a concrete strike-off elevation. That is, the rigid bar could be supported at either end thereof (e.g., by one floating pan and a fixed-length or extendable-length post, by two floating pans, etc.) such that the entire rigid bar stays above the wet concrete. The end of the strike-off straightedge could then be equipped with a guide that would ride along an element of the suspended bar, e.g., the bar's top. One realization of this embodiment is illustrated by way of example in FIGS. 8 and 9. In FIG. 8, form apparatus 80 is configured with brackets 83 and 84 that cause rigid bar 85 to be suspended over unfinished concrete 106. Strike-off straight edge 200 has a bracket or guide 201 (FIG. 9) coupled to the end thereof with guide 201 being designed to position the bottom of straightedge 200 at the desired grade as guide 201 rides along top 85A of bar 85.

The advantages of the present invention are numerous. The apparatus can be used by itself or in concert with a multiplicity thereof to set temporary forms for a concrete strike-off operation. Since each such apparatus operates independently, each is set to provide a form at the locally desired finish grade. Since nothing needs to be extracted from a finished region, the apparatus maintains the integrity of a struck-off surface. The present method of partially or fully floating supports for a rigid bar that defines a reference elevation for concrete strike-off operations provides accuracy, portability, and repeatability attributes that are not possible with current concrete strike-off systems/methods.

Although the invention has been described relative to specific embodiments thereof, there are numerous other variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A form for concrete strike-off, comprising:

a pan adapted to float on plastic concrete;

a post pivotably coupled on one end thereof to said pan for rotation in at least one plane relative to said pan;

a rigid straightedge having first and second ends opposing one another along a longitudinal dimension thereof;

means for coupling said first end of said straightedge to said post wherein, when said post is perpendicular to said pan, said first end can be adjusted to an elevation relative to said pan; and a support coupled to said second end of said straightedge with said straightedge defining a reference elevation for concrete strike-off operations.

2. A form as in claim 1 further comprising a laser receiver adjustably mounted to said second end of said straightedge.

3. A form as in claim 1 further comprising a laser receiver adjustably mounted to said support.

4. A form as in claim 1 wherein said support includes means for adjusting an elevation of said second end of said straightedge.

5. A form as in claim 1 wherein said support is adapted to float on plastic concrete.

6. A form as in claim 1 wherein said pan is beveled along at least a portion of the edges thereof to facilitate movement of said pan on plastic concrete.

7. A form for concrete strike-off, comprising:

a pan adapted to float on plastic concrete;

a post pivotably coupled on one end thereof to said pan;

a rigid straightedge having first and second ends opposing one another along a longitudinal dimension thereof;

a rigid bracket rigidly coupled to said first end of said straightedge and loosely coupled to said post;

means coupled to said post and cooperating with said rigid bracket for fixing said rigid bracket to a position on said post wherein said position defines an elevation of said first end relative to said pan when said post is perpendicular to said pan; and a support coupled to said second end of said straightedge with said support including means for adjusting an elevation of said second end of said straightedge thereby defining a desired height for leveling the plastic concrete.

8. A form as in claim 7 further comprising a laser receiver adjustably mounted to said second end of said straightedge.

9. A form as in claim 7 further comprising a laser receiver adjustably mounted to said support.

10. A form as in claim 7 wherein said support is adapted to float on plastic concrete.

11. A form as in claim 7 wherein said pan is beveled along at least a portion of the edges thereof to facilitate movement of said pan on plastic concrete.

12. A method of defining a reference elevation for a concrete strike-off operation, comprising the steps of:

providing a rigid straightedge having first and second ends opposing one another along a longitudinal dimension thereof;

supporting said first end from a first support that floats on a plastic concrete surface; and that is coupled to said first end to allow said first support to be moved to a new location on the plastic concrete, by movement of said straightedge supporting said second end from a second support such that said straightedge defines a reference elevation for a concrete strike-off operation.

13. A method according to claim 12 wherein said reference elevation defines a concrete strike-off elevation.

14. A method according to claim 12 wherein said reference elevation is parallel to a concrete strike-off elevation.

15. A method according to claim 12 wherein said second support rests on an underlying structure on which the plastic concrete is supported.

16. A method according to claim 12 wherein said second support floats on plastic concrete.

17. A form for concrete strike-off, comprising:

a first support adapted to float on plastic concrete;

a rigid straightedge having first and second ends opposing one another along a longitudinal dimension thereof, said first end coupled to said first support; and to allow said first support to be moved to a new location on the plastic concrete, by movement of said straightedge a second support coupled to said second end of said straightedge with said straightedge defining a reference elevation for concrete strike-off operations.

18. A form as in claim 17 wherein said first end is fixedly coupled to said first support.

19. A form as in claim 17 wherein said first end is coupled to said first support for relative movement with respect thereto.

20. A form as in claim 17 wherein said first end is movably coupled to said first support such that said first end can at least be rotated relative to said first support.

21. A form as in claim 17 wherein said first support includes means for adjusting an elevation of said first end of said straightedge.

22. A form as in claim 17 wherein said second support includes means for adjusting an elevation of said second end of said straightedge.

23. A form as in claim 17 wherein said first support includes means for adjusting an elevation of said first end of said straightedge, and wherein said second support includes means for adjusting an elevation of said second end of said straightedge.

24. A form as in claim 17 further comprising a laser receiver adjustably mounted to said second end of said straightedge.

25. A form as in claim 17 further comprising a laser receiver adjustably mounted to said second support.

26. A form as in claim 17 wherein said second support is adapted to float on plastic concrete.

27. A form as in claim 17 wherein said first support is beveled along at least a portion of the edges thereof to facilitate movement of said first support on plastic concrete.

28. A form assembly for concrete strike-off, comprising:

first and second portable forms, each of said first and second portable forms having (i) a first support adapted to float on plastic concrete, (ii) a rigid straightedge having first and second ends opposing one another along a longitudinal dimension thereof, said first end coupled to said first support to allow said first support to be moved to a new location on the plastic concrete by movement of said straightedge, and (iii) a second support coupled to said second end of said straightedge with said straightedge;

said straightedge that is associated with said first portable form, opposing and spaced apart from said straightedge that is associated with said second portable form, thereby defining a reference elevation for concrete strike-off operations.

* * * * *